US006572151B2

(12) United States Patent
Jarvis et al.

(10) Patent No.: US 6,572,151 B2
(45) Date of Patent: Jun. 3, 2003

(54) LABEL/FORM COMBINATION ASSEMBLY

(75) Inventors: Steve Jarvis, Swanton, VT (US); Ken Whitcomb, Franklin, VT (US); Eric Severy, Georgia, VT (US)

(73) Assignee: Bertek Systems, Inc., Swanton, VT (US)

( * ) Notice: Subject to any disclaimer, the term of this patent is extended or adjusted under 35 U.S.C. 154(b) by 0 days.

(21) Appl. No.: 09/911,362

(22) Filed: Jul. 23, 2001

(65) Prior Publication Data

US 2003/0015868 A1 Jan. 23, 2003

(51) Int. Cl.[7] ..... B42D 15/00

(52) U.S. Cl. ..... 283/101; 283/98; 283/94; 283/81; 281/2; 428/40.1; 428/41.8

(58) Field of Search ..... 281/2, 15.1, 21.1, 281/38; 283/79, 80, 81, 101, 105, 98, 94, 117; 462/6, 12, 13; 428/40.1, 41.8, 42.2, 42.3; 40/299, 630

(56) References Cited

U.S. PATENT DOCUMENTS

| | | | | |
|---|---|---|---|---|
| 3,111,449 A | | 11/1963 | Gold et al. | |
| 4,475,830 A | * | 10/1984 | Schaefer | 156/235 |
| 4,545,517 A | * | 10/1985 | Olson | 226/92 |
| 4,568,108 A | * | 2/1986 | Simpson | 281/2 |
| 4,627,994 A | | 12/1986 | Welsch | |
| 4,696,843 A | | 9/1987 | Schmidt | |
| 4,865,669 A | | 9/1989 | Schmidt | |
| 5,006,191 A | | 4/1991 | Schmidt | |
| RE33,616 E | | 6/1991 | Welsch | |
| 5,135,789 A | | 8/1992 | Schmidt | |
| 5,254,381 A | | 10/1993 | Hoffmann et al. | |
| 5,642,906 A | | 7/1997 | Foote et al. | |
| 5,855,395 A | | 1/1999 | Foote et al. | |

* cited by examiner

*Primary Examiner*—Willmon Fridie, Jr.
(74) *Attorney, Agent, or Firm*—Hahn Loeser & Parks LLP; Michael H. Minns

(57) ABSTRACT

The present invention is directed to a label/form combination assembly which will be able to withstand the harsh environment present in a laser printer in both simplex and duplex imaging modes. The label/form combination document is constructed of two separate materials joined together at a coplanar joint. A variable image receptive, pressure sensitive stock being comprised of a coplanar combination of facestock, pressure sensitive adhesive and release liner overlapping a laser bond paper is used in the label/form combination. A joint is formed when a portion of the liner of the pressure sensitive stock is removed, exposing its pressure sensitive adhesive. The exposed pressure sensitive adhesive is adhered to a strip of the laser quality bond sheet to create a bond between the label and the bond sheet. A remaining portion of the liner is adhered to the laser bond sheet with a cold bond adhesive that results in a double bond. The finished construction is die cut to form at least one rounded corner.

23 Claims, 4 Drawing Sheets

LABEL/FORM COMBINATION ASSEMBLY

BACKGROUND OF THE INVENTION

This invention relates to a label/form combination and method of manufacturing, and more particularly, to a label/form combination that is designed to allow the label/form combination to withstand the harsh environment of a laser printer during both simplex and duplex imaging processes.

There are known labels/forms in the marketplace that are designed for use with laser printers in a simplex mode. These labels/forms typically utilize common methods of bonding the two dissimilar materials of the label/form together. The different materials may be a pressure sensitive label stock and laser bond paper for example. One common method employs the use of a "cold glue" that adheres the back of the liner of the pressure sensitive material to the face of the laser quality bond sheet. Usually, a portion of the facestock of the pressure sensitive material and the pressure sensitive adhesive is stripped away at the joint, leaving only the thickness of the liner of the press sure sensitive material and the laser bond sheet at the joint. This allows a gradual change in the thickness of the material and provides for trouble free processing through the laser printer. This construction would appear to be a reasonable solution for a simplex or duplex laser imaging application. However, at times, the end user wants to utilize the area of the facestock that is usually stripped away. When the facestock of the pressure sensitive label is left intact and not stripped away and imaging is required at the joint, the increased thickness of the joint results in less than desirable imaging at the joint. The thickness at the joint comprised of the facestock adhering liner and bond paper results in an area of the construction that is thick enough to increase its thermal mass and results in less than desirable toner adhesion and transfer. Additionally, as the remaining label stock on the joint strip is fully removable from its liner, if a portion of the form is provided on facestock that is fully removable, the end user runs the risk of having a portion of the form removed undesirably. For example, a receipt may have a portion of the form which is a combination of pressure sensitive adhesive sheet and bond sheet that could be undesirably removed using this prior construction.

Another common method is the joining of a pressure sensitive stock and a laser bond sheet by utilizing the adhesive of the pressure sensitive stock as the bonding agent instead of using the cold glue. In this construction, a portion of the liner material of the pressure sensitive stock is removed to expose the pressure sensitive adhesive coating on the back of the facestock. The exposed pressure sensitive adhesive area is then laminated over the face of the laser bond in order to create the label/form combination bond or joint. Only the pressure sensitive adhesive on the label stock is used to form the label/form joint. When this type of joint is used in a laser printer in duplex mode, two passes through the fuser are made. This tends to weaken the bond between the laser sheet and the adhesive from the label stock and has been known to weaken the joint and cause separation of the joint due to the high heat of the laser printer and the longer dwell time associated with duplexing operations.

Another problem inherent in this type of label/form construction is found in association with duplex imaging. As described above, the higher temperatures and increased dwell times can cause curling of the label/form combination, which can result in the label/form jamming the printer. This may be particularly problematic with respect to the use of short grain designed products where the bond paper is in a short grain direction in the printer. In the duplex imaging mode, the sheet needs to pass through the fuser twice, and significant temperatures can be generated. This can result in rapid loss of moisture by the heated sheet after its first pass through the fusing station. Moisture gained in the bond portion of the structure escapes rapidly, causing the short grain sheet to curl and jam in the feed path, particularly in high humidity environments, where it may have absorbed additional moisture.

Another problem is with label/forms "dog earring", which can occur within a laser printer when a 90° corner on the label/form catches on an internal part within the printer feed path causing the label/form to fold over at that corner and possibly causing a misfeed, jam or poor imaging.

It is therefore an object of this invention to set forth a label/form combination assembly, which avoids the disadvantages and previously mentioned limitations of typical current document assemblies.

SUMMARY OF THE INVENTION

In one aspect of the present invention, this is accomplished by providing a business form comprising a releasable label sheet comprising a label stock having one side coated with pressure sensitive adhesive and a release stock having one side coated with a release agent. The pressure sensitive adhesive is engaged with the release stock coated surface, with the label sheet having a strip of exposed pressure sensitive adhesive along an edge thereof. A laser printable sheet is adhesively connected to the label sheet by both a strip of adhesive applied to the back of the release stock non-coated side and the laser printable sheet, and the strip of exposed pressure sensitive adhesive. Additionally, at least one and preferably all four corners of the laser printable sheet are die cut forming a radius (rounded) corner to reduce the possibility of forming "dog ears."

The foregoing and other aspects will become apparent from the following detailed description of the invention when considered in conjunction with the accompanying drawing figures.

BRIEF DESCRIPTION OF THE INVENTION

DESCRIPTION OF THE PREFERRED EMBODIMENTS

Figure 1:
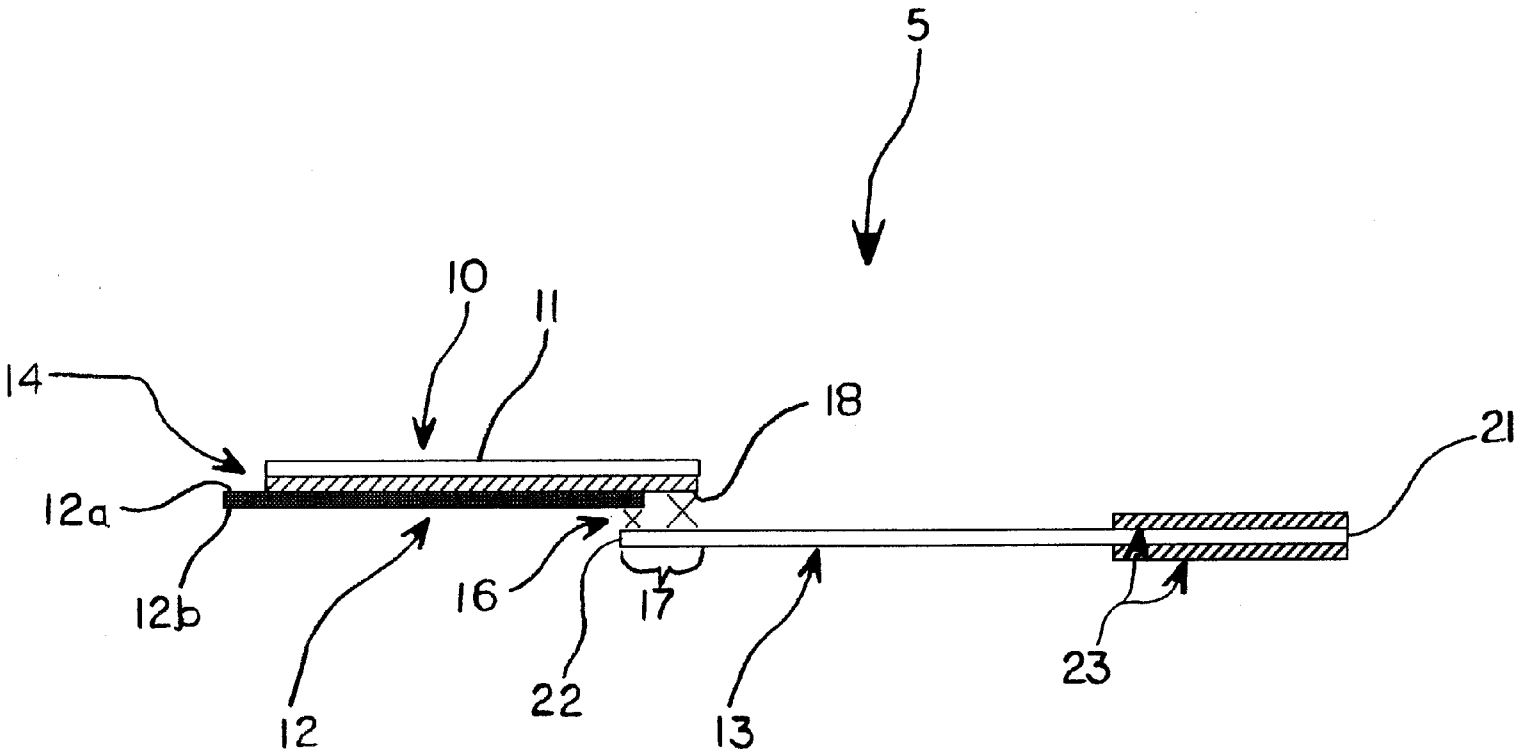
FIG. 1 is a schematic side view of the preferred embodiment of the completed construction of the label/form combination assembly.

As shown in the FIGURES, a business form 5 according to an embodiment of the invention is comprised of a releasable label sheet 10 joined with a laser printable sheet 13. Preferably, the laser printable sheet 13 is a short grain bond paper. The releasable label sheet 10 includes label stock 11 with a coating of pressure sensitive adhesive 14 on one side and a release stock 12 having a release coating 12*a* on the side engaging the pressure sensitive adhesive 14. In a preferred embodiment, the non-coated side 12*b* of the release stock 12 is capable of being printed by a laser printer.

The pressure sensitive adhesive along one edge of the label stock 11 is left exposed, shown at 18. A strip of cold bond adhesive 16 is applied to the non-coated side 12*b* of the release stock 12 adjacent the exposed pressure sensitive adhesive 18. The cold bond adhesive 16 has characteristics to allow appropriate bonding between the sheets while not being subject to losing or altering the bonding characteristics when heat is applied in the printing process at the fusing station, either in simplex or duplex imaging. The preferred cold bond adhesive is a solventless, aqueous adhesive. A leading edge 22 of the laser printable sheet 13 is joined with the releasable label sheet 10 by both the applied cold bond adhesive 16 and the exposed pressure sensitive adhesive 18 at an overlap area 17. To better improve the feeding of form 5 through a laser printer, one or more of the corners 25 of the releasable label stock 10 may be radiused or rounded if desired.

Joining the releasable label stock 10 and the laser printable sheet 13 in this manner yields two results: a thinner joint and a firmly anchored joint for simplex or duplex printing. Although the construction is effective in simplex printing, many of the advantages of the construction are particularly suited for duplex imaging. As previously explained, another problem associated with duplex printing, particularly with short grain paper is curl. In duplex printing, the form needs to pass through the fuser station twice. What commonly happens, especially in a high humidity environment, is the tendency for the form to curl after the first pass through the fusing station. Moisture gained in the bond paper portion of the form escapes rapidly causing the short grain sheet to curl and jam in the feed path. To overcome this problem, a portion of the laser printable sheet 13 may be coated with a moisture barrier coating 23 proximate a trailing edge 21 of the laser printable sheet 13. Preferably, the moisture barrier coating 23 is a UV curable primer coating. This coating prevents any moisture gain at that point and provides a flat leading edge on the second pass of the form through the printer. This coating is applied to at least one side of the laser printable paper 13 at its trailing edge 21 and preferably to both the face and the back of the laser printable paper 13. There is no limit as to how much of the paper sheet can be coated. The entire laser printable sheet 13 can be coated with the moisture barrier coating 23. However, it is preferable that only a portion of the laser printable sheet 13 proximate the trailing edge 21 is coated.

This construction yields distinct advantages, including providing a thinner joint, and creating a joint which is more firmly anchored for simplex or duplex imaging purposes. The resulting product is better suited for duplex imaging in that the joint is more streamlined for ease of feeding through the laser printer. Also, the primary bond is more resistant to the heat generated by the laser printer and greatly reduces the possibility of the assembly falling apart.

Figure 3:
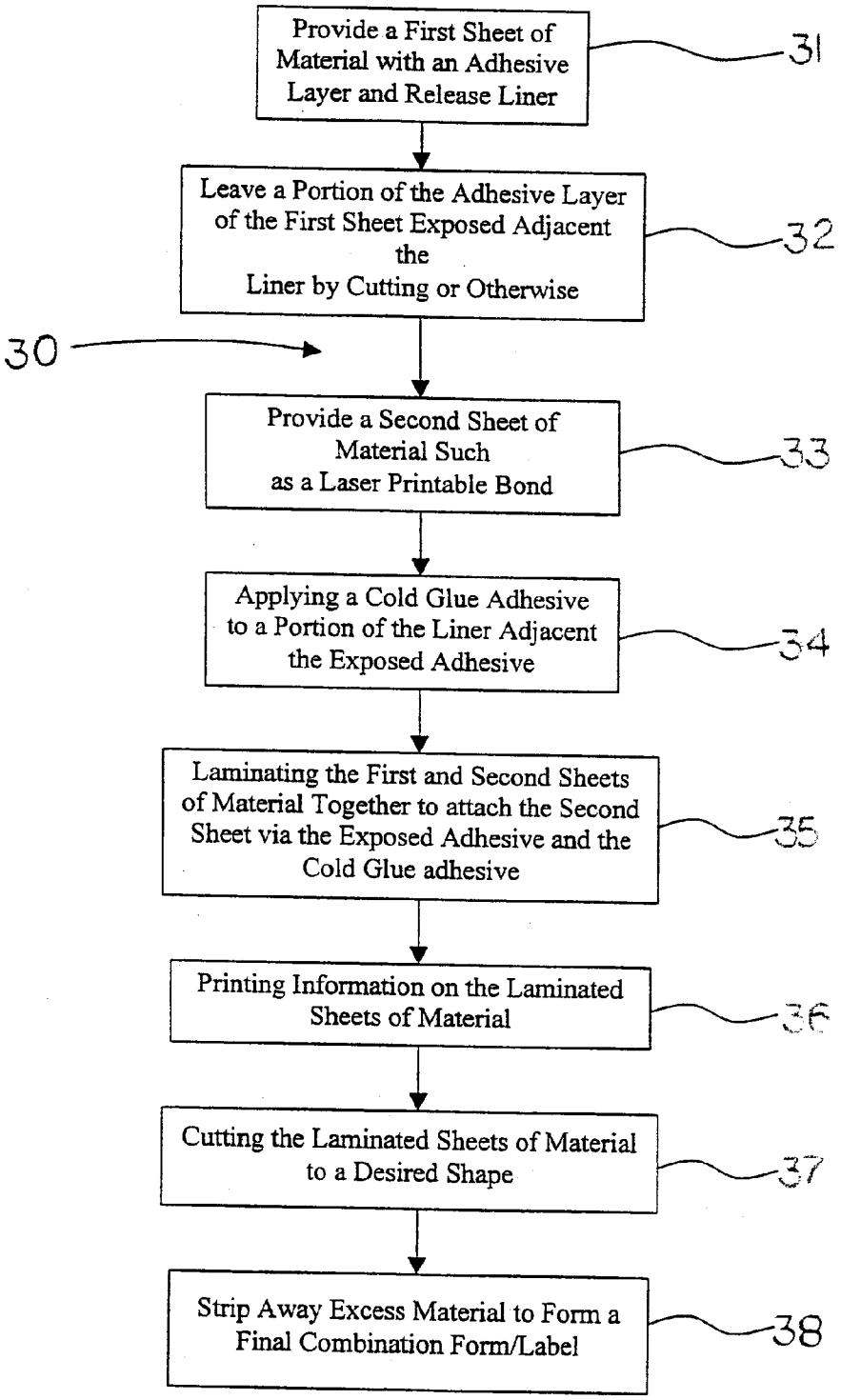
FIG. 3 is a block diagram of a method according to the invention.

A method 30 of producing a cutsheet label/form combination assembly according to the invention is shown in FIG. 3. The method provides a label or form which will be able to withstand the use of a laser printer during both simplex and duplex imaging. The method comprises the steps of providing a sheet of material at 31 having a front side and a rear side. The sheet of material is provided with a precoated layer of adhesive on its rear side or such an adhesive coating is applied. A release liner is applied to the layer of adhesive coating to protect the adhesive until use of the label/form is desired. The liner is further formed or cut at 32 such that a portion thereof on one edge of the liner does not cover the adhesive coating, leaving it exposed. Thereafter, a second sheet of material is provided at 33, and an adhesive is applied thereto in a position next to the exposed portion of adhesive adjacent the liner at 34. The first and second sheets are laminated together at 35, and thereafter the combination may be printed upon in a printing process at 36, such as flexography. The finished assembly may be cut as necessary for the particular application at 37, and any excess material stripped away at 38 to make a combination label/form 5 according to the invention.

The form 5 of the present invention is better suited for duplex printing in that the joint is more streamline for ease of feeding through the laser printer and the primary bond (cold glue) is resistant to the heat generated by the laser printer and therefore reduces the risk of the combined label/form failing apart at the joint. Further, the construction of this new joint may also be used for duplex printing with removable labels on both sides. The moisture barrier coating at the trailing edge of the laser printable paper 13 provides the dimensional stability required for trouble-free feeding through the paper path of the printer in a variety of printing environments, particularly high humidity conditions.

Figure 1A:
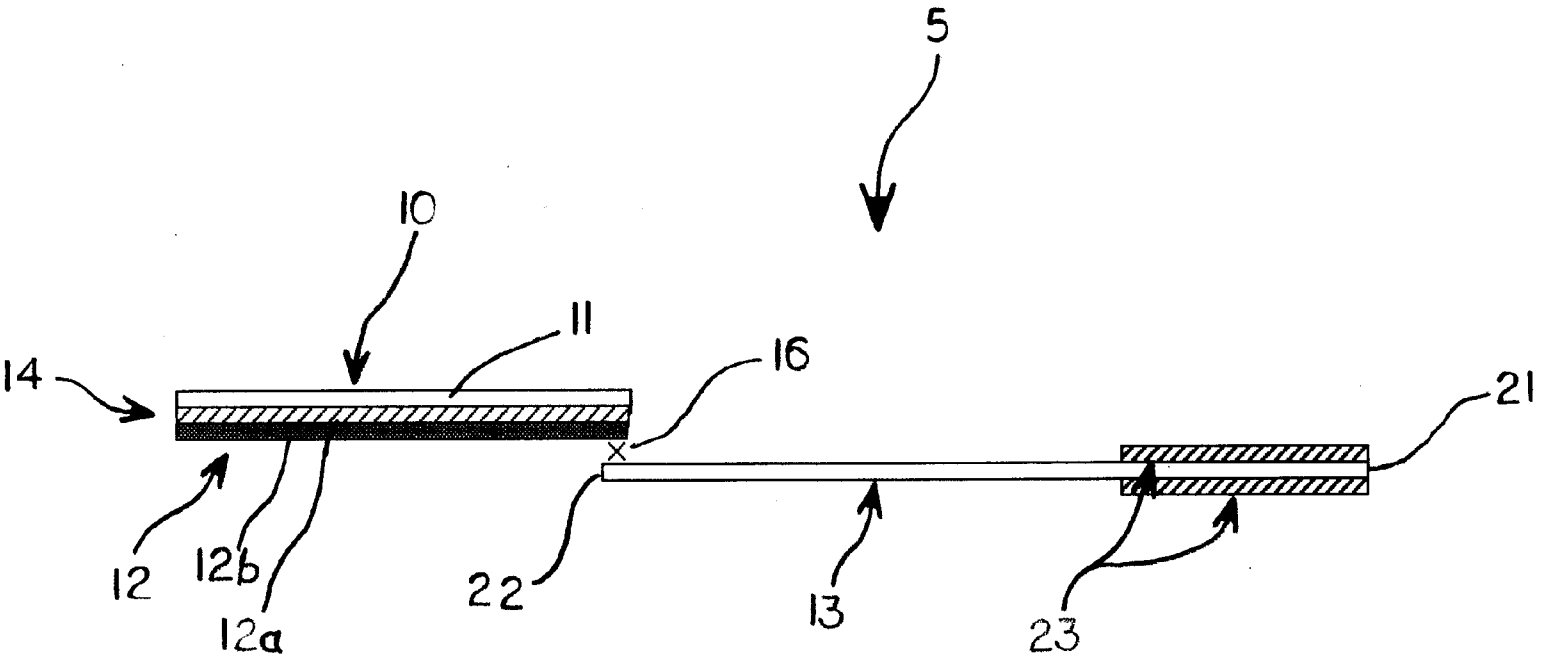
FIG. 1A is a schematic side view of an alternate embodiment of the completed construction of the label/form combination assembly.
Figure 2:
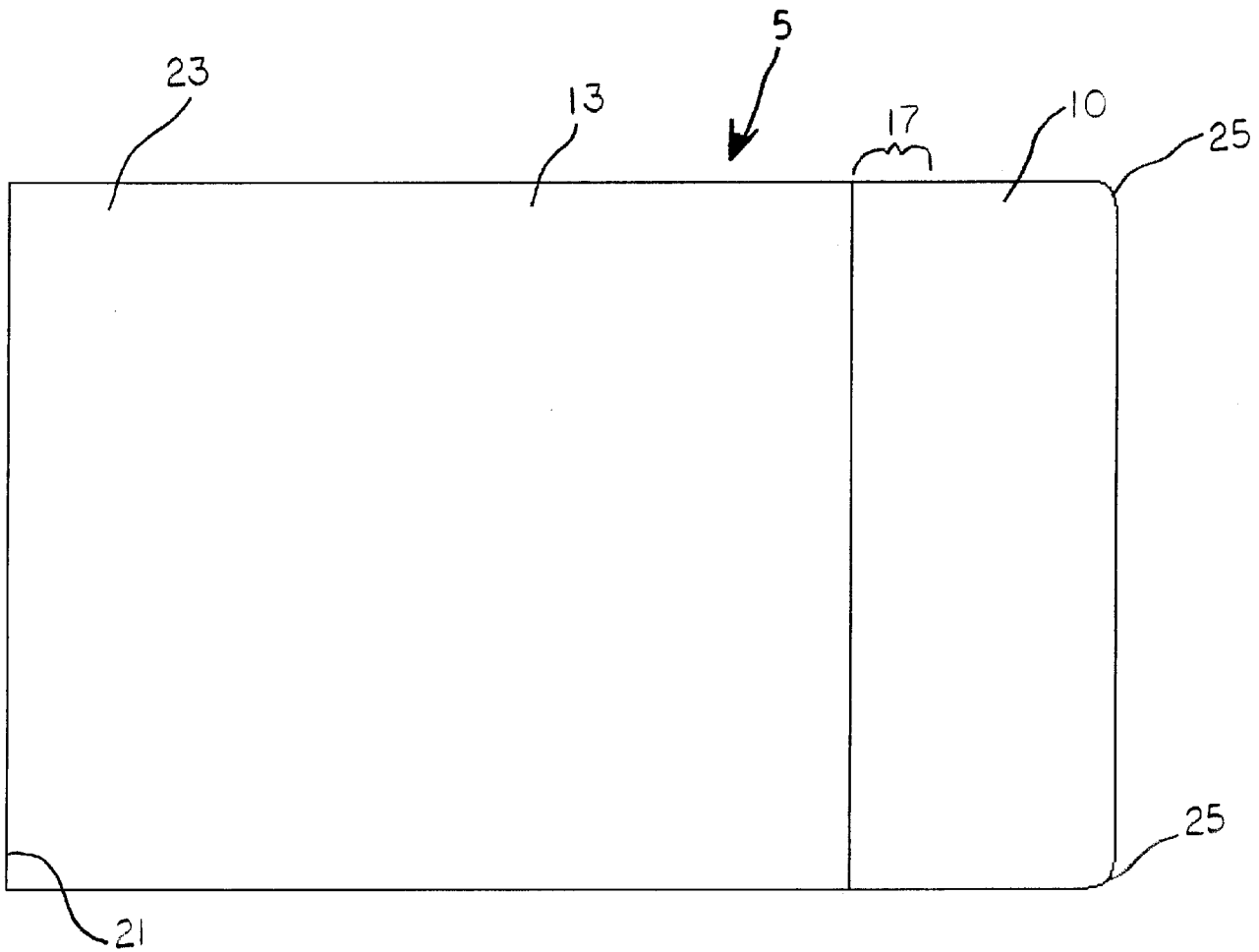
FIG. 2 is a plan view of the label/form combination assembly shown in FIG. 1.

An alternate embodiment of business form 5 is shown in FIG. 1A. In this embodiment, the business form 5 is also comprised of a releasable label sheet 10 joined with a laser printable sheet 13. The releasable label sheet 10 includes label stock 11 with a coating of pressure sensitive adhesive 14 on one side and a release stock having a release coating 12*a* on the side engaging the pressure sensitive adhesive 14. In a preferred embodiment, the non-coated side 12*b* of the release stock 12 is capable of being printed by a laser printer. The release stock 12 completely covers the pressure sensitive adhesive 14. A strip of cold bond adhesive 16 is used to join the releasable label sheet 10 to the laser printable sheet 13. To better improve the feeding of form 5 through a laser printer, one or more of the corners 25 of the releasable label stock 10 may be radiused or rounded. In a preferred embodiment, all four corners 25 are rounded.

A portion of the laser printable sheet 13 may be coated with a moisture barrier coating 23 proximate a trailing edge 21 of the laser printable sheet 13. This coating prevents any moisture gain at that point and provides a flat leading edge on the second pass of the form through the printer. This coating is applied to at least one side of laser printable paper 13 at its trailing edge 21 and, preferably to both the face and the back of the laser printable paper 13. There is no limit as to how much of the paper sheet can be coated. The entire laser printable sheet 13 can be coated with the moisture barrier coating 23. However, it is preferable that only a portion of the laser printable sheet 13 proximate the trailing edge 21 is coated.

While the invention has been described in connection with specific embodiments thereof, it is clearly to be understood that this is done only by way of example and not as a limitation to the scope of the invention as set forth in the objects thereof and in the appended claims.

What is claimed is:

1. A business form comprising:

a sheet of first stock of a desired width having one side coated with a pressure sensitive adhesive;

a sheet of second stock of about the desired width having a release side engaged with the adhesive on the coated side of the sheet of first stock, a longitudinally extending portion of the sheet of first stock extending beyond the engaged sheet of second stock, wherein a narrow strip of pressure sensitive adhesive is exposed;

a narrow strip of adhesive applied to the non-engaged surface of the sheet of second stock adjacent the narrow strip of exposed pressure sensitive adhesive; and a sheet of third stock adhered at one edge to the narrow strip of exposed pressure sensitive adhesive and the adjacent narrow strip of applied adhesive.

2. The business form according to claim 1, wherein the sheet of third stock is laser printable stock.

3. The business form according to claim 1, wherein the sheet of third stock is duplex laser printable stock capable of being printed on both sides.

4. The business form according to claim 1, wherein the sheet of third stock has a trailing edge and a leading edge, the leading edge being adhesively attached to the combined sheet of first stock and sheet of second stock by the narrow strip of exposed pressure sensitive adhesive and the adjacent narrow strip of applied adhesive, the sheet of third stock having a moisture barrier on at least one surface extending from proximate the trailing edge towards the leading edge.

5. The business form according to claim 1, wherein the sheet of third stock is a short grain paper stock.

6. The business form according to claim 1, wherein at least one corner of the business form is curved.

7. The business form according to claim 1, wherein the non-engaged surface of the sheet of second stock comprises a printable surface.

8. The business form according to claim 1, wherein the sheet of first stock is cut into one or more sections.

9. The business form according to claim 1, wherein the applied adhesive is a cold bond adhesive.

10. A business form comprising:

a releasable label sheet comprising a label stock having one side coated with pressure sensitive adhesive and a release stock having one side coated with a release agent, the pressure sensitive adhesive engaging the release stock coated surface, the label sheet having a front edge, a rear edge, and two side edges extending from the front edge to the rear edge, the label sheet having a strip of exposed pressure sensitive adhesive along the rear edge extending from proximate one side edge to proximate the other side edge;

a laser printable sheet adhesively connected to the label sheet by both: a strip of adhesive applied to the release stock non-coated side and the laser printable sheet; and the strip of exposed pressure sensitive adhesive.

11. The business form according to claim 10, wherein the laser printable sheet is duplex laser printable stock capable of being printed on both sides.

12. The business form according to claim 10, wherein the laser printable sheet has a trailing edge and a leading edge, the leading edge being adhesively attached to the label sheet by both the strip of adhesive and the strip of exposed pressure sensitive adhesive, the laser printable sheet having a moisture barrier on the at least one surface extending from proximate the trailing edge towards the leading edge.

13. The business form according to claim 10, wherein at least one corner of the business form is curved.

14. The business form according to claim 10, wherein the release stock non-coated side comprises a printable surface.

15. The business form according to claim 10, wherein the label sheet is cut into one or more sections.

16. The business form according to claim 10, wherein the applied adhesive is a cold bond adhesive.

17. A duplex business form comprising:

a releasable label sheet comprising a label stock cut into one or more sections and having one side coated with pressure sensitive adhesive and a release stock having one side coated with a release agent, the pressure sensitive adhesive engaging the release stock coated surface, the label sheet having a front edge, a rear edge, and two side edges extending from the front edge to the rear edge, the label sheet having a strip of exposed pressure sensitive adhesive along the rear edge extending from proximate one side edge to proximate the other side edge, the release stock non-coated side comprising a printable surface; and a duplex laser printable sheet, capable of being printed on both sides, adhesively connected to the label sheet by both: a strip of cold bond adhesive applied to the release stock non-coated side and the laser printable sheet; and the strip of exposed pressure sensitive adhesive, the laser printable sheet having a trailing edge and a leading edge, the leading edge being adhesively attached to label sheet by both the strip of cold bond adhesive and the strip of exposed pressure sensitive adhesive, the laser printable sheet having a moisture barrier on at least one surface extending from proximate the trailing edge towards the leading edge.

18. A business form comprising:

a releasable label sheet comprising a label stock having one side coated with pressure sensitive adhesive and a release stock having one side coated with a release agent, the pressure sensitive adhesive engaging the release stock coated surface, the label sheet having a front edge, a rear edge, and two side edges extending from the front edge to the rear edge, the label sheet having a strip of exposed pressure sensitive adhesive along the rear edge extending from proximate one side edge to proximate the other side edge; and a laser printable sheet adhesively connected to the label sheet by both: a strip of cold adhesive applied to the release stock non-coated side and the laser printable sheet; and the strip of exposed pressure sensitive adhesive.

19. A duplex business form comprising:

a releasable label sheet comprising a label stock cut into one or more sections and having one side coated with pressure sensitive adhesive and a release stock having one side coated with a release agent, the pressure sensitive adhesive engaging the release stock coated surface; and a laser printable sheet adhesively connected to the label sheet by a strip of cold bond adhesive applied to the release stock non-coated side and the laser printable sheet, the laser printable sheet having a trailing edge and a leading edge, the leading edge being adhesively attached to the label sheet by the strip of cold bond adhesive, the laser printable sheet having a moisture barrier on at least one surface extending from proximate the trailing edge towards the leading edge.

20. The business form according to claim 19, wherein the release stock non-coated side comprises a printable surface and the laser printable sheet is capable of being printed on both sides.

21. The business form according to claim 19, wherein at least one corner of the business form is rounded.

22. A duplex business form comprising:

a releasable label sheet comprising a label stock cut into one or more sections and having one side coated with pressure sensitive adhesive and a release stock having one side coated with a release agent, the pressure sensitive adhesive engaging the release stock coated surface, the release stock non-coated side comprising a printable surface; and a duplex laser printable sheet, capable of being printed on both sides, adhesively connected to the label sheet by a strip of cold bond adhesive applied to the release stock non-coated side and the laser printable sheet, at least one corner of the business form being rounded.

23. The duplex business form according to claim 22, wherein the laser printable sheet has a trailing edge and a leading edge, the leading edge being adhesively attached to label sheet, the laser printable sheet has a moisture barrier on at least one surface extending from proximate the trailing edge towards the leading edge.

* * * * *